US009627155B2

(12) United States Patent
Heiermeier et al.

(10) Patent No.: US 9,627,155 B2
(45) Date of Patent: Apr. 18, 2017

(54) ELECTRICAL SWITCHING DEVICE WITH A TRIPLE MOTION CONTACT ARRANGEMENT

(71) Applicant: ABB Schweiz AG, Baden (CH)

(72) Inventors: Helmut Heiermeier, Wutoeschingen (DE); Jadran Kostovic, Wettingen (CH); Jakub Korbel, Baden (CH); Reto Karrer, Stafa (CH); Sami Kotilainen, Niederrohrdorf (CH); Timothy Sutherland, Zweidlen (CH); Brant Suhrie, Erie, PA (US)

(73) Assignee: ABB Schweiz AG, Baden (CH)

( * ) Notice: Subject to any disclaimer, the term of this patent is extended or adjusted under 35 U.S.C. 154(b) by 0 days.

(21) Appl. No.: 14/741,074

(22) Filed: Jun. 16, 2015

(65) Prior Publication Data

US 2015/0279582 A1 Oct. 1, 2015

Related U.S. Application Data

(63) Continuation of application No. PCT/EP2013/077439, filed on Dec. 19, 2013, which (Continued)

(51) Int. Cl.
*H01H 3/46* (2006.01)
*H01H 3/00* (2006.01)
(Continued)

(52) U.S. Cl.
CPC ..... *H01H 3/46* (2013.01); *H01H 3/00* (2013.01); *H01H 33/64* (2013.01); *H01H 33/904* (2013.01); *H01H 33/91* (2013.01)

(58) Field of Classification Search
CPC .. H01H 3/00; H01H 3/42; H01H 3/46; H01H 33/64; H01H 33/904; H01H 33/901; H01H 33/245; H01H 33/91; H01H 2033/028
(Continued)

(56) References Cited

U.S. PATENT DOCUMENTS 5,293,014 A * 3/1994 Perret ..... H01H 33/905 218/57
6,013,888 A * 1/2000 Thuries ..... H01H 33/12 218/14
(Continued)

FOREIGN PATENT DOCUMENTS

DE 19622460 A1 11/1997
DE 10003359 C1 7/2001
(Continued)

OTHER PUBLICATIONS

Translation of EP 0809269 (Org. doc. published Nov. 27, 1997).*
(Continued)

*Primary Examiner* — Renee Luebke
*Assistant Examiner* — William Bolton
(74) *Attorney, Agent, or Firm* — Whitmyer IP Group LLC

(57) ABSTRACT

A contact arrangement has a longitudinal axis and includes a first contact group with a first contact and a second contact and a second contact group with a third contact and a fourth contact. The first contact interacts electrically and mechanically with the third contact, and/or the second contact interacts electrically and mechanically with the fourth contact, for closing and opening the contact arrangement. At least one mechanical coupling is provided for transmitting an actuation force to the second contact group and thereby moving the second contact group. The at least one mechanical coupling is adapted to move the third and the fourth
(Continued)

contact in such a way that their speeds differ along at least a portion of a travel path of the third contact or along at least a portion of a travel path of the fourth contact.

31 Claims, 5 Drawing Sheets

Related U.S. Application Data is a continuation of application No. 13/721,817, filed on Dec. 20, 2012, now abandoned.

(51) Int. Cl.
*H01H 33/90* (2006.01)
*H01H 33/64* (2006.01)
*H01H 33/91* (2006.01)

(58) Field of Classification Search
USPC .. 218/154, 153, 146, 140, 7, 14, 13, 16, 20, 218/59
See application file for complete search history.

(56) References Cited

U.S. PATENT DOCUMENTS 8,013,268 B2 * 9/2011 Ozil ..... H01H 33/904 218/155
8,080,185 B2 * 12/2011 Luly ..... H01B 3/56 252/571
8,304,677 B2 * 11/2012 Yoon ..... H01H 33/904 218/78
2001/0025827 A1 10/2001 Hunger et al.

FOREIGN PATENT DOCUMENTS

| | | | |
|---|---|---|---|
| DE | 102012205224 | A1 | 10/2013 |
| EP | 0696040 | A1 | 2/1996 |
| EP | 1930930 | A1 | 6/2008 |
| FR | 2491675 | A1 | 4/1982 |
| WO | 2012155952 | A1 | 11/2012 |
| WO | 2014096219 | A1 | 6/2014 |

OTHER PUBLICATIONS

International Preliminary Report on Patentability Application No. PCT/EP2013/077439 Issued: Jun. 23, 2015 8 pages.

International Search Report and Written Opinion of the International Searching Authority Application No. PCT/EP2013/077439 Completed: Mar. 12, 2014; Mailing Date: Mar. 21, 2014 12 pages.

* cited by examiner

ELECTRICAL SWITCHING DEVICE WITH A TRIPLE MOTION CONTACT ARRANGEMENT

FIELD OF THE INVENTION

The invention relates to the field of medium and high voltage switching technologies and concerns a contact arrangement and an electrical switching device with such a contact arrangement according to the independent claims, particularly for a use as an earthing device, a fast-acting earthing device, a circuit breaker, a generator circuit breaker, a switch disconnector, a combined disconnector and earthing switch, or a load break switch in power transmission and distribution systems.

BACKGROUND OF THE INVENTION

Electrical switching devices are well known in the field of medium and high voltage switching applications. They are e.g. used for interrupting a current when an electrical fault occurs. As an example for an electrical switching device, circuit breakers have the task of opening contacts and keeping them far apart from one another in order to avoid a current flow, even in case of high electrical potential originating from the electrical fault itself. For the purposes of this disclosure the term medium voltage refers to voltages from 1 kV to 72.5 kV and the term high voltage refers to voltages higher than 72.5 kV. The electrical switching devices, like said circuit breakers, may have to be able to carry high nominal currents of 5000 A to 8300 A and to switch very high short circuit currents of 83 kA to 80 kA at very high voltages of 550 kV to 1200 kV.

Because of the high nominal current, the electrical switching devices of today require many so-called nominal contact fingers for the nominal current. When disconnecting (opening) a nominal or short circuit current within the electrical switching devices, the current commutates from nominal contacts of the electrical switching device to its arcing contacts. When connecting (dosing) the nominal contacts of the electric switching device, also the arcing contacts are connected. They normally comprise as a first arcing contact arcing contact fingers arranged around the longitudinal axis of the electrical switching device in a so-called arcing finger cage and, as a second arcing contact, a rod which is driven into the finger cage.

During the closing and opening process of the electrical switching device an electric arc forms between the first and the second arcing contact, which damages the contacts over time. In order to minimize this damage the electrical switching devices contain a fluid used to quench the electric arc as fast as possible. Another measure is to limit the time period for the entire closing and opening process of the nominal and arcing contacts, particularly the time period or time interval between contacting the nominal contacts and contacting the arcing contacts or between separating the nominal contacts and separating the arcing contacts. This time constraint results in the necessity of accelerating and decelerating the nominal contact and the arcing contact on one side of the electrical switching device according to the given time period. The contacts have to have a certain cross-section in order to be able to carry the required current. Very high voltage circuit breakers require a longer distance between contacts in an opened state in order to avoid electrical breakdown. Hence, considerable forces are necessary to accelerate and/or decelerate the contacts and the additional moving parts of the switching device. These forces may lead to increased mechanical stress on the moving parts of the contact arrangement and even to mechanical failures, thus reducing the lifetime of such an electrical switching device. Furthermore, particles are generated during the switching process of the circuit breaker, which can result in dielectric failures.

The invention starts from EP 0 696 040 A1 which discloses a circuit breaker with an auxiliary gear for double-motion. An independent movement of arcing contact pin and nominal contact on one side of the circuit breaker is provided by a cog wheel linked to two force-transmitting levers. The cog wheel is for introducing the force from an axially movable shaft.

DE 10 2012 205 224 A1 discloses a circuit breaker with an auxiliary gear for double-motion. An independent movement of arcing contact pin and nominal contact on one side of the circuit breaker is provided by a two-armed rigid lever with integrated cam disk for driving the arcing contact pin.

DE 196 22 460 A1 discloses a circuit breaker with an auxiliary gear for double-motion. An independent movement of arcing contact pin and nominal contact on one side of the circuit breaker is provided by a two-armed rigid lever linked to two force-transmitting levers. The two-armed rigid lever has an integrated long hole for introducing the force from an axially movable shaft.

WO 2012/155952 A1 discloses a circuit breaker with a first gear on a drive side for coupling the driven nominal contact via levers nonlinearly to the arcing contact tulip and with a second auxiliary gear distant from the drive side for reverse movement of the arcing contact pin.

FR 2 491 675 discloses a circuit breaker with an auxiliary gear for providing double motion of both pin and tulip. A semi-mobile pin is disclosed which is spring-loaded and can be retracted abruptly by the force of the spring.

EP 1 930 930 A1 discloses a circuit breaker with a non-linear auxiliary gear for double-motion.

SUMMARY OF THE INVENTION

Thus, it is an objective of the present invention to provide an improved contact arrangement. This task is solved by the contact arrangement and circuit breaker according to the invention.

In a first aspect of the invention the objective is solved by a contact arrangement having a longitudinal axis and comprising a first contact group with a first and a second contact and a second contact group with a third and a fourth contact. The first contact interacts electrically and mechanically with the third contact for closing and opening the contact arrangement. Additionally or alternatively the second contact interacts electrically and mechanically with the fourth contact for closing and opening the contact arrangement. At least one mechanical coupling is provided for transmitting an actuation force to the second contact group and thereby moving the second contact group. The at least one mechanical coupling is adapted to move the third and the fourth contact in such a way that their speeds differ along at least a portion of a travel path of the third contact or along at least a portion of a travel path of the fourth contact. The at least one mechanical coupling is a linkage having a first kinematic chain and a second kinematic chain. The first kinematic chain is movably connected to the first contact group in an electrically insulating manner and the second kinematic chain is movably connected to the second contact group (3*b*, 4*b*). The first kinematic chain has at least two levers, with a first lever of the first kinematic chain being rotationally connected to a bearing and being fixedly connected to a first lever of the second kinematic chain, and an end lever of the first kinematic chain being movably connected to the first contact group.

By designing the mechanical coupling in said way it is possible to decrease the forces acting on the contacts. This is due to the fact that the accelerations and/or decelerations of the third or the fourth contact, respectively, can be chosen to be different from one another, having values which take into account their respective travel path. For example, if the travel path of the fourth contact is longer than the travel path of the third contact, the acceleration of the third contact can be reduced. Consequently, mechanical stress on the moving parts of the contact arrangement or the switching device is reduced. Furthermore it is possible to fine-tune the time periods between the closing of the first and third contact and the closing of the second and fourth contact independently from one another, and/or between the opening of the first and third contact and the opening of the second and fourth contact independently from one another. By using at least a linkage as a mechanical coupling, the transmission of an actuating force to the second contact group is simplified, thus reducing cost.

In a second aspect of the invention the objective is solved by an electrical switching device comprising such a contact arrangement. For closing and opening said electrical switching device the first contact group is movable along the longitudinal axis for providing the actuation force transmitted to the second contact group by the mechanical coupling of the contact arrangement according to a predefined transmission ratio and/or speed curve. Said actuation force can alternatively be provided by an actuator of the electrical switching device.

The first alternative is advantageously used in circuit breakers for which both contact groups are movable relatively to one another for closing and/or opening the electrical switching device. By using the first contact group for actuating the second contact group it is possible to save up additional actuators and thus to reduce the cost of the switching device.

The second alternative is advantageously used in circuit breakers for which only the second contact group is movable and the first contact group is fixed, in this case said actuator is used for moving the second contact group.

In embodiments, the first and the third contact are nominal contacts, and/or the second and the fourth contact are arcing contacts; and/or the first contact group is on one side of an arcing zone of the circuit breaker, and the second contact group is on the other side of the arcing zone, when seen along the longitudinal axis z.

In embodiments, the first kinematic chain is movably connected to the first contact group by an intermediary member, in particular a connecting rod or tube, which intermediary member is linearly movable parallel to the longitudinal axis z by a mechanical force, in particular a mechanical force exerted on the intermediary member by a movable insulating nozzle of the first contact group.

In embodiments, the first lever and a second lever, in particular the end lever, of the first kinematic chain are connected by a common joint; and/or the connecting rod is attached to the second lever, in particular the end lever, of the first kinematic chain by an end joint.

In embodiments, the first lever and a second lever, in particular the end lever, of the second kinematic chain are connected by a common joint; and/or the second lever, in particular the end lever, of the second kinematic chain is pivotably attached by an end joint to the second contact group.

In embodiments, the common joint connecting the first lever with the second lever of the first kinematic chain performs a rotational movement around the bearing; and/or

- the common joint connecting the first lever with the second lever of the second kinematic chain performs a rotational movement around the bearing; and/or
- the end joints perform a linear movement parallel to the longitudinal axis z; and/or
- a joint connecting the bearing with the first lever of the first kinematic chain is stationary and only allows a rotational movement of this first lever; and/or
- a joint connecting the bearing with the first lever of the second kinematic chain is stationary and only allows a rotational movement of this first lever.

In one embodiment the mechanical coupling comprises a first and a second linkage. The end levers (herein also called end links) of the first kinematic chain of each one of the linkages are pivotably connected, in particular by end joints, to the first contact group in such a way that they are commonly moved by the first contact group, in particular are moved simultaneously. In particular, the end joints of the end levers of the first kinematic chains perform a linear movement parallel to the longitudinal axis z.

In embodiments, an end link or end lever of the second kinematic chain of each one of the linkages is pivotably connected, in particular by an end joint, to the third contact or the fourth contact, respectively. By this it is possible to keep the linkages simple. In particular, the end joints of the end levers of the second kinematic chains perform a linear movement parallel to the longitudinal axis z. Advantageously, a transmission ratio between the first kinematic chain and the second kinematic chain of the first linkage is not equal to a transmission ratio between the first kinematic chain and the second kinematic chain of the second linkage. By using two linkages with different transmission ratios a higher flexibility is achieved with regard to the travel path of the third and the fourth contact.

In other embodiments, the mechanical coupling comprises only one linkage and the second kinematic chain of the linkage comprises two end links or end levers, one of which is connected at one end to the third contact and the other one is connected at one end to the fourth contact. This is a cost-saving and space-saving design. In particular, the connection is made pivotably by an end joint, in one embodiment each end link or end lever of the second kinematic chain is pivotably connected to a neighbouring lever or link of the second kinematic chain by a distinct joint, in an alternative embodiment the two end links or end levers of the second kinematic chain are connected to a neighbouring lever or link of the second kinematic chain by a common joint. Advantageously, the common joint connects one of the end lever or end links of the second kinematic chain pivotably with the fourth contact and the other end lever or end link of the second kinematic chain is connected fixedly to the third contact, and in particular comprises a guide rail guiding the common joint, in particular, a difference between the transmission ratio of the first kinematic chain with the one branch of the second kinematic chain and a transmission ratio of the first kinematic chain with the other branch of the second kinematic chain is given by a shape of the guide rail, preferably by a steepness of the sides of the guide rail relative to the longitudinal axis z. Advantageously, a transmission ratio between the first kinematic chain and the second kinematic chain with one of its end levers or end links is not equal to a transmission ratio between the first kinematic chain and the second kinematic chain with the other one of its end levers or end links.

BRIEF DESCRIPTION OF THE DRAWINGS

Embodiments, advantages and applications of the invention result from the now following description and by means of the figures. It is shown in.

DETAILED DESCRIPTION OF THE INVENTION

Figure 1:
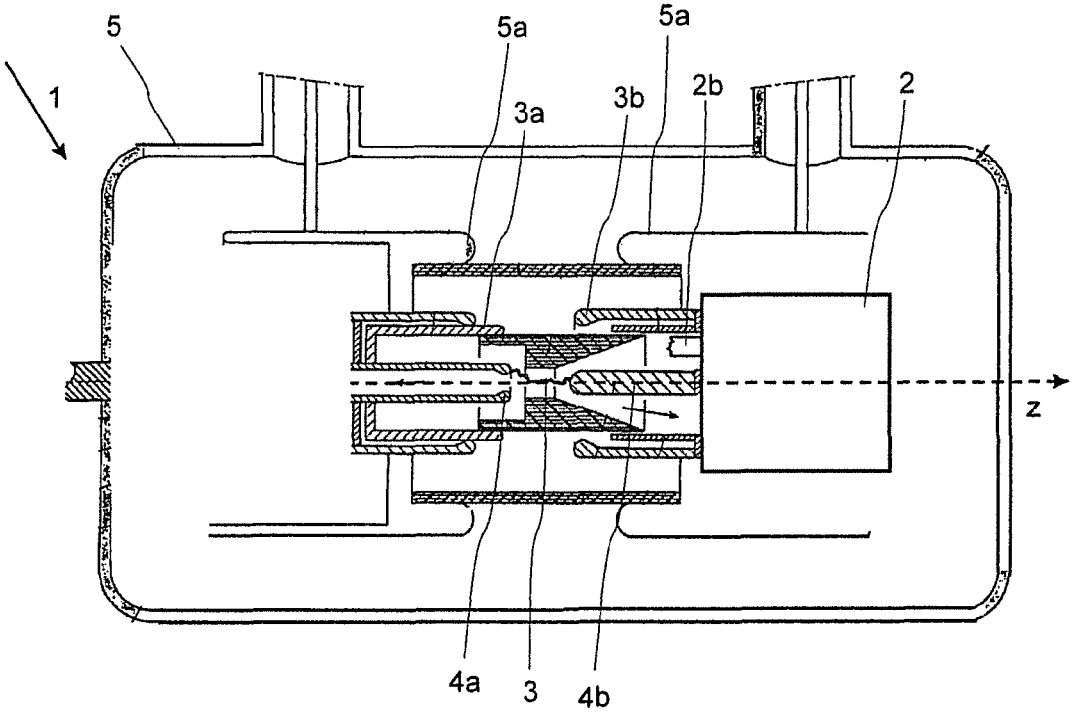
FIG. 1 is a sectional side view of an embodiment of a high voltage circuit breaker with a mechanical coupling.

The invention is described for the example of a high voltage circuit breaker, but the principles described in the following also apply for the usage of the invention in other switching devices, e.g. of the type mentioned at the beginning.

In the following, same reference numerals denote structurally or functionally same or similar elements of the various embodiments of the invention.

FIG. 1 shows exemplarily a sectional side view of an embodiment of a high voltage circuit breaker 1 during an opening process, with a mechanical coupling 2. The circuit breaker 1 without the mechanical coupling 2 is rotationally symmetric about a longitudinal axis z. Only the elements of the circuit breaker 1 which are related to the present invention will be described in the following, other elements present in the figures are not relevant for understanding the invention and are known by the skilled person in high voltage electrical engineering. The first contact is typically a first nominal contact 3*a* and the second contact is a first arcing contact 4*a*, both of them belonging to the first contact group. Accordingly, the third contact is a second nominal contact 3*b* and the fourth contact is a second arcing contact 4*b*.

The circuit breaker 1 is enclosed by a shell or enclosure 5 which is normally or substantially cylindrical and arranged around the longitudinal axis z. The first nominal contact 3*a* comprises a plurality of contact fingers, of which only two are shown here for reasons of clarity. The nominal contact fingers are formed as a finger cage around the longitudinal axis z. The second mating nominal contact 3*b* normally is a tube or metal tube. A shielding 5*a* can be arranged around the first and the second nominal contact 3*a*, 3*b*, and the first and the second arcing contact 4*a*, 4*b*. Analogue to the first nominal contact 3*a* also the first arcing contact 4*a* comprises multiple fingers arranged in a finger cage. The second arcing contact 4*b* is normally rod-shaped.

The first contact group 3*a*, 4*a* is movable relatively to the second contact group 3*b*, 4*b* from a closed configuration, in which the respective contacts of the groups are in electrical contact to one another, info an opened configuration shown in FIG. 1, in which they are apart from one another, and vice versa. It is also possible that only the second contact group 3*b*, 4*b* moves parallel to the longitudinal axis z and the first contact group 3*a*, 4*a* is stationary. For the explanatory purposes of the present invention the first alternative is assumed. However, the invention is not limited to this configuration.

An "opened configuration" as used herein means that the nominal contacts 3*a*, 3*b* and/or the arcing contacts 4*a*, 4*b* of the circuit breaker 1 are opened. Accordingly, a "closed configuration" as used herein means that the nominal contacts 3*a*, 3*b* and/or the arcing contacts 4*a*, 4*b* of the circuit breaker 1 are closed. In particular, "opened configuration" and "closed configuration" relate to end positions of the nominal contacts 3*a*, 3*b* and/or arcing contacts 4*a*, 4*b*.

As mentioned the circuit breaker 1 is shown during an opening process of the electrical switching device 1 with an electric arc 3 between the arcing contacts 4*a*, 4*b*. This type of circuit breaker is known and will only be described in more detail here with respect to the actuation of the second contact group 3*b*, 4*b* and particularly with respect to the transmission of an actuation force to the second contact group 3*b*, 4*b* by the mechanical coupling 2.

Figure 2:
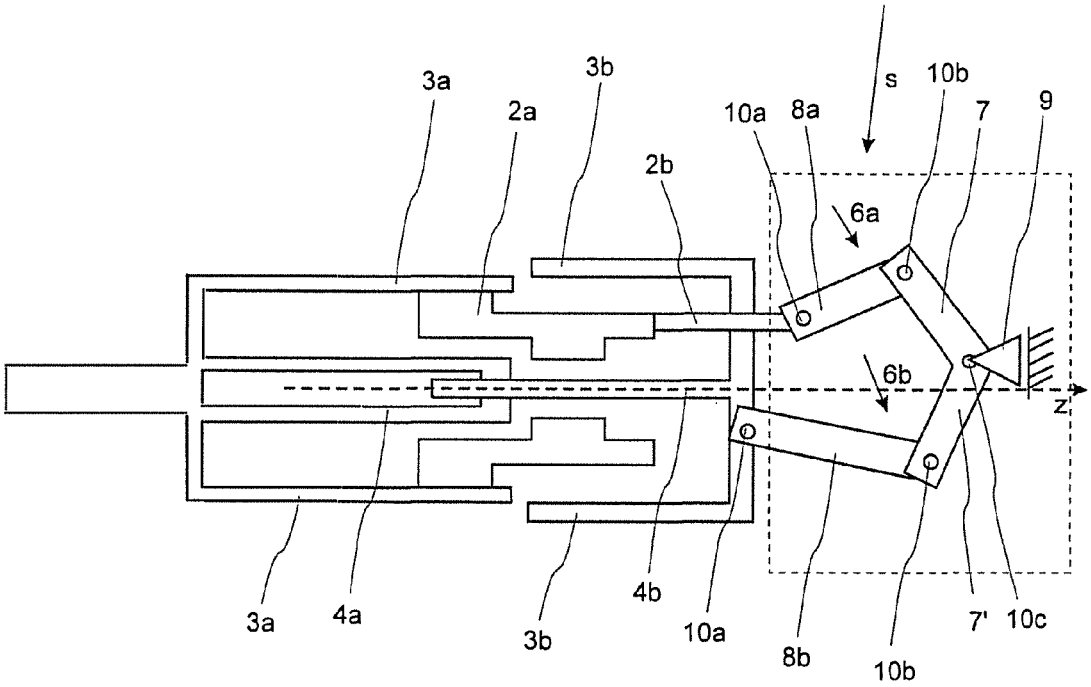
FIG. 2 is a detail sectional side view of the contacts of the circuit breaker of FIG. 1 with a contact arrangement according to the prior art.

FIG. 2 shows a detail sectional side view of the contact arrangement of the circuit breaker 1, which is according to the prior art a full double motion interrupter.

The circuit breaker 1 is shown during a closing process in this figure, in an instant when the second arcing contact 4*b* has already established contact to the mating arcing contact 4*a*. In the position of FIG. 2 (and FIG. 3-5) the nominal contacts 3*a*, 3*b* are shown in a still opened configuration. For opening the circuit breaker 1 the first contact group 3*a*, 4*a* is moved in the opposite direction of the arrow z and for dosing the circuit breaker 1 it is moved in the direction of the arrow z. These assumptions are also valid for embodiments of the invention according to FIG. 3-5.

An insulating nozzle 2*a* is fixedly attached to the first contact group 3*a*, 4*a*. The main purpose of the insulating nozzle 2*a* is to control a flow of the fluid used to extinguish the electric arc 3 of FIG. 1. It is furthermore used to move an intermediary member 2*b*. The intermediary member may be a connecting rod 2*b* which is attached to a first kinematic chain 6*a* of a mechanical coupling s. The first kinematic chain 6*a* comprises a first lever 7 and a second lever 8*a*, which are connected by a joint 10*b*. The connecting rod 2*b* is attached to this second lever 8*a* by an end joint 10*a*. The mechanical coupling s further comprises a second kinematic chain 6*b* and is rotationally attached to a bearing 9 by means of a joint 10*c*. The second kinematic chain 6*b* comprises a first lever 7' and a second lever 8*b*, which are connected by a joint 10*b*. The second lever 8*b* is pivotably attached to the second contact group 3*b*, 4*b* by an end joint 10*a*. In the following the joints depicted by a circle and having the same reference numeral can be assumed to be of the same type throughout the disclosure. The joints 10*a* perform a linear movement parallel to the longitudinal axis z. The joints 10*b* connecting the first levers 7, 7' with the second levers 8*a*, 8*b* of each kinematic chain 6*a*, 6*b* respectively, perform a rotational movement around the bearing 9. The joint 10*c* connecting the bearing 9 with the first levers 7, 7' is stationary and only allows a rotational movement of the first levers 7, 7'. It is noted that the first and the second kinematic chain 6*a*, 6*b* may have more than two levers, depending on the spatial arrangement of the mechanical coupling with respect to the second contact group 3*b*, 4*b*. For the purposes of exemplary disclosure only two levers are assumed and then the "second" lever is equivalent to an "end" lever regarding its naming. The first lever 7, 7' of one of the kinematic chains 6*a*, 6*b* is fixedly connected to the first lever 7', 7 of the other kinematic chain 6*b*, 6*a*. In other words the first levers 7, 7' may be made in one piece, with one leg belonging to the first kinematic chain 6*a* and the other leg belonging to the second kinematic chain 6*b*.

As mentioned above, an end joint 10*a* couples the second contact group 3*b*, 4*b* to the mechanical coupling s. In the figure, the nominal contact 3*b* and the arcing contact 4*b* are shown to be connected by a bar containing the end joint 10*a*. This is intended for illustration purposes to emphasize a rigid mechanical connection between the contacts 3*b*, 4*b* and that they are moved simultaneously via the end joint 10*a*.

For the purposes of this entire disclosure the term "kinematic chain" is interpreted as an assembly of rigid bodies movably connected by joints or other elements. The rigid bodies, or levers, are constrained by their connections to other levers. The levers for the mechanical coupling may e.g. be metal bars.

In the following, the contact arrangement according to the prior art is replaced by embodiments of contact arrangements according to the invention, as triple motion interrupters, in this context "triple motion" refers to a motion of the first contact group 3*a*, 4*a*, a motion of the arcing contact 4*b* and a motion of the nominal contact 3*b*, whereas "double motion refers to a motion of the first contact group 3*a*, 4*a* and a motion of the second contact group 3*b*, 4*b*.

Figure 3:
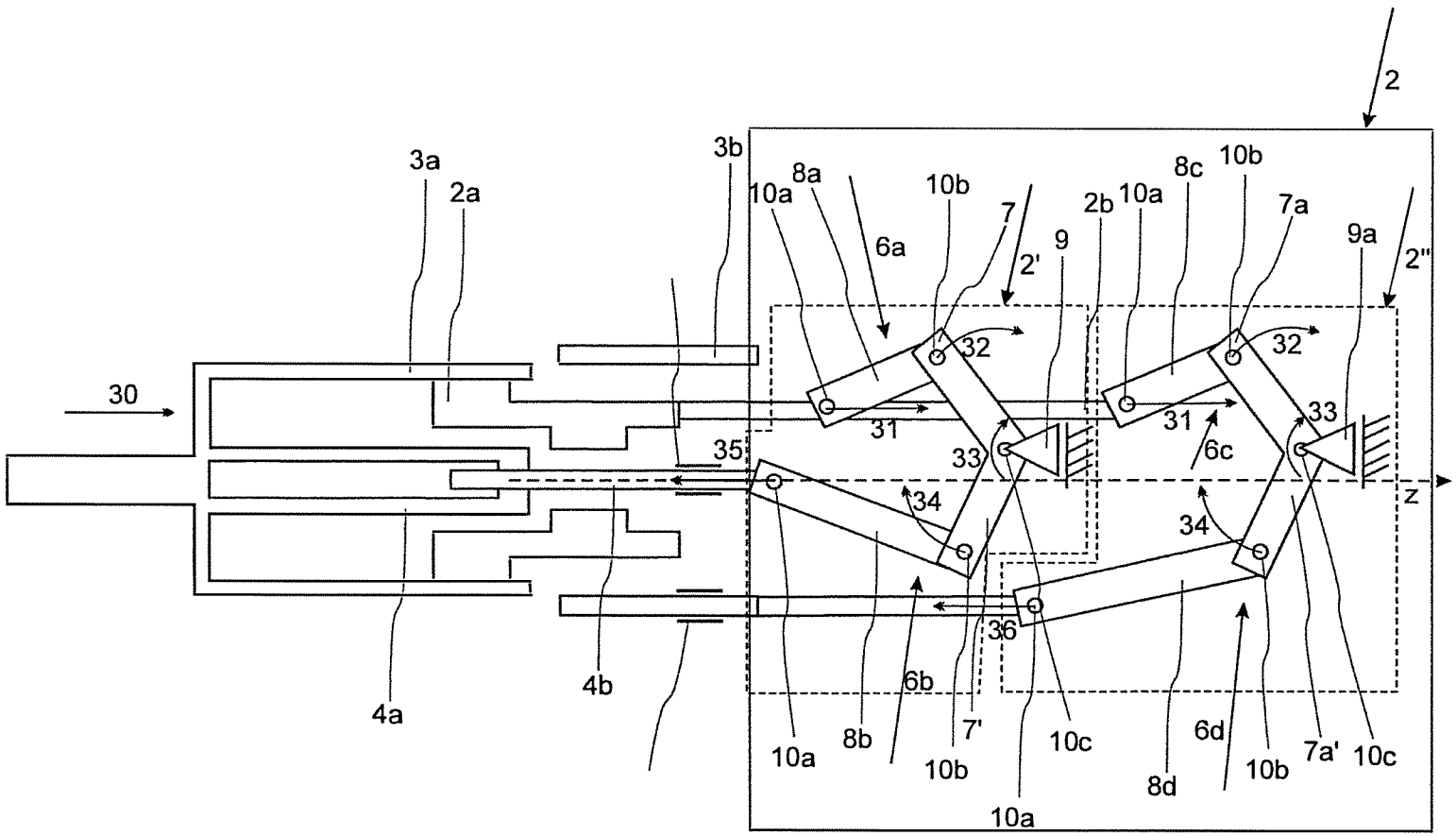
FIGS. 3, 4 and 5 are each detailed sectional side views of the contacts of the circuit breaker of FIG. 1 for a first, second and third embodiment, respectively, of a contact arrangement according to the invention.

FIG. 3 shows a detail sectional side view of the contacts 3*a*, 3*b*, 4*a*, 4*b* of the circuit breaker 1 with a first embodiment of a contact arrangement according to the invention, in this embodiment a mechanical coupling 2 comprises a first and a second linkage 2', 2". The first linkage 2' comprises a first and a second kinematic chain 6*a* and 6*b*, each of which is formed by a first lever 7, 7' and an end lever 8*a*, 8*b*, respectively. The second linkage 2" comprises a first and a second kinematic chain 6*c* and 6*d*, each of which is formed by a first lever 7*a*, 7*a'* and an end lever 8*c*, 8*d*, respectively. The first linkage 2' is attached to a bearing 9 and the second linkage 2" is attached to a bearing 9*a*. The end levers 8*a*, 8*c* of the first kinematic chains 6*a*, 6*c* are both connected to an intermediary member 2*b*. Preferably, the intermediary member 2*b* is a connecting rod or tube or bar 2*b* which is linearly movable parallel to the longitudinal axis z by a mechanical force exerted on it, for example by a moving insulating nozzle 2*a* connected to the first contact group 3*a*, 4*a* or otherwise by an intermediary member of any kind. The insulating nozzle 2*a* has been explained in connection with FIG. 2. Such an arrangement of the connecting rod 2*b* and the insulating nozzle 2*a* is also preferred for the subsequent embodiments of the invention according to FIGS. 4 and 5. By this connection type it is made sure that the second contact group 3*b*, 4*b* is not moved before the first contact group 3*a*, 4*a* is moved. This alternative can e.g. be used for circuit breakers 1 featuring two movable contact groups.

The end levers 8*a*, 8*c* may also be connected to another type of actuating device (not shown) arranged within the circuit breaker 1. By this it is made sure that the second contact group 3*b*, 4*b* can be moved independently of the first contact group 3*a*, 4*a*. This alternative can e.g. be used for circuit breakers 1 featuring a fixed contact group (here the first contact group) and a movable contact group (here the second contact group).

It shall be noted that the usage of an alternative actuator for the first linkage 2' and the second linkage 2" is possible for ail embodiments of the mechanical coupling 2 (e.g. of FIGS. 4 and 5) if the type of circuit breaker used requires this arrangement.

In embodiments, the electrical switching device 1 comprises a contact arrangement having a longitudinal axis z and comprises a first contact group 3*a*, 4*a* with a first contact 3*a* and a second contact 4*a* and a second contact group 3*b*, 4*b* with a third contact 3*b* and a fourth contact 4*b*; wherein the first contact 3*a* interacts electrically and mechanically with the third contact 3*b* and/or the second contact 4*a* interacts electrically and mechanically with the fourth contact 4*b* for closing and opening the contact arrangement; wherein at least one mechanical coupling 2 is provided for transmitting an actuation force to the second contact group 3*b*, 4*b* and thereby moving the second contact group 3*b*, 4*b*; wherein the at least one mechanical coupling 2', 2"; 2 is adapted to move the third contact 3*b* and the fourth contact 4*b* in such a way that their speeds differ along at least a portion of a travel path of the third contact 3*b* or along at least a portion of a travel path of the fourth contact 4*b*; wherein the at least one mechanical coupling is a linkage 2', 2"; 2 having a first kinematic chain 6*a*, 6*c*; 6*a* and a second kinematic chain 6*b*, 6*d*; 6*b*; the second kinematic chain 6*b*, 6*d*; 6*b* is movably connected to the second contact group 3*b*, 4*b*; and the first kinematic chain 6*a*, 6*c*; 6*a* has at least two levers 7, 7*a*; 8*a*, 8*c*, with a first lever 7, 7*a* of the first kinematic chain 6*a*, 6*c*; 6*a* being rotationally connected to a bearing 9, 9*a* and being fixedly connected to a first lever 7', 7*a'* of the second kinematic chain 6*b*, 6*d*; 6*b*; and an end lever 8*a*, 8*c* of the first kinematic chain 6*a*, 6*c*; 6*a* is moveably connected to an actuator of the electrical switching device 1 for providing the actuation force transmitted to the second contact group 3*b*, 4*b* by the mechanical coupling 2 of the contact arrangement according to a predefined transmission ratio and/or speed curve.

In the following the movement of the individual moving parts of the circuit breaker 1 are explained for the case when the circuit breaker 1 is being closed, based on the double arrows 30 to 36. The opening of the circuit breaker 1 is analogous, with the double arrows pointing into the opposite direction. It shall be noted that the double arrows 31 to 34 of the first linkage 2' and of the second linkage 2" indicate in FIG. 3 a same movement of the respective element with respect to direction and distance and/or speed, whereas the double arrows 35 and 36 indicate a same movement of the respective element only with respect to direction, but not with respect to distance and/or speed. Double arrows starting inside a joint represent the movement of the joint. Double arrows arranged around a joint represent a movement of levers.

In a first step the first contact group 3*a*, 4*a* is shifted along the longitudinal axis z in the direction of the arrow 30. By this, the nozzle 2*a*, which is fixedly attached to the first contact group 3*a*, 4*a*, and the connecting rod 2*b* also move in this direction. Consequently, the joints 10*a* of the end levers 8*a*, 8*c* of the first kinematic chains 6*a*, 6*c* of the respective linkages 2", 2" also perform a linear movement in the direction of the arrows 31. Thereby, the joints 10*b* connecting the end levers 8*a* and 8*c* with the respective first levers 7, 7*a* are pushed in the direction of the arrows 32. The respective first levers 7, 7*a* thereby rotate about their corresponding bearing 9, 9*a* (arrows 33), causing the joints 10*b* between the first levers 7', 7*a'* and the end levers 8*b*, 8*d* of the corresponding second kinematic chains 6*b*, 6*d* to perform a rotation in the direction of the arrows 34. By this, the end levers 8*b*, 8*d* of the respective second kinematic chain 6*b*, 6*d* are pushed in a linear direction of the arrows 35 and 36 respectively. Each end lever 8*b*, 8*d* pushes, via the respective joints 10*a*, the respective contact of the second contact group 3*b*, 4*b* towards the first contact group 3*a*, 4*a*. The length or shape in general of the end levers 8*b*, 8*d* determine the shifting distance of the respective contact 3*b*, 4*b* and/or their shifting speed.

As can be seen in FIG. 3 by the "thicker" lines 19, the third contact 3*b* and/or the fourth contact 4*b* is or are provided each with a guiding element 19 for guiding the third contact 3*b* and/or the fourth contact 4*b*, respectively, along a linear path during the closing and the opening of the contact arrangement. The provision of the guiding element or elements 19 is preferred, because it supports the respective contact against radial force components acting on it when the mechanical coupling 2 is actuated for opening or closing the contact arrangement. The following embodiments of the invention are also preferably provided with such guiding elements 19.

Figure 4:
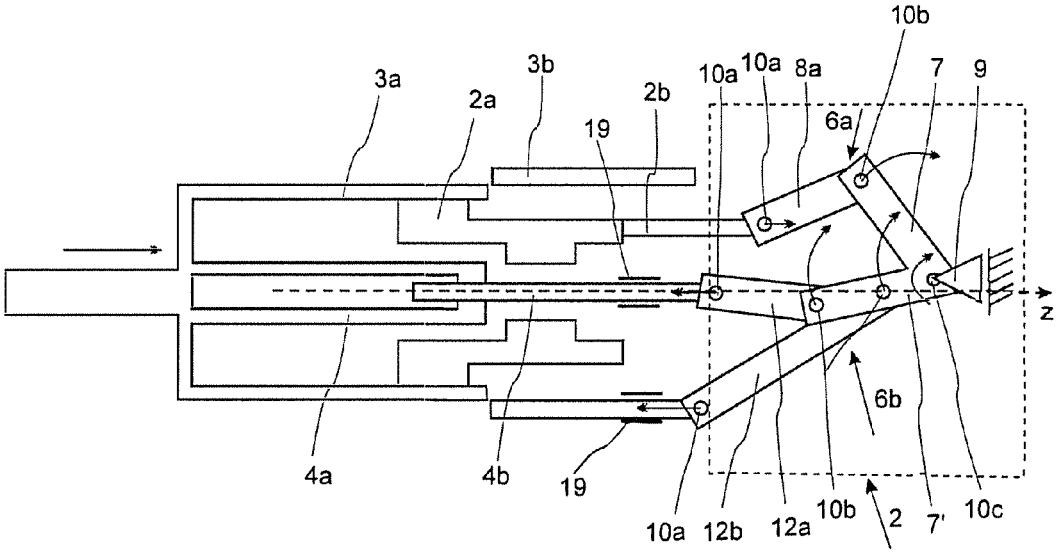

FIG. 4 shows a detailed sectional side view of the contacts 3*a*, 3*b*, 4*a*, 4*b* of the circuit breaker 1 in a second embodiment of a contact arrangement according to the invention, in this embodiment the mechanical coupling is formed by a single linkage 2. The first kinematic chain 6*a* of the linkage 2 is the same as the first kinematic chains of the linkages 2', 2" of the embodiment of FIG. 3 and is also connected by an end joint 10*a* to a connecting rod 2*b*. Therefore it will not be described in more detail. The second kinematic chain 6*b* of the linkage 2 has a first end lever 12*a* which is pivotably connected to the fourth contact 4*b* and a second end lever 12*b* which is pivotably connected to the third contact 3*b*. The end levers 12*a*, 12*b* are connected at their other end to the first lever 7' of the second kinematic chain 6*b* by means of two distinct joints 10*b*. In this embodiment the transmission ratios between the first kinematic chain 6*a* and the two branches of the second kinematic chain 6*b* is different. The difference between the two ratios is given by the relative design and arrangement of the two branches, and in particular on the one hand by the distance between the joints 10*b* linking the first lever 7' of the second kinematic chain 6*b* with each one of the end levers 12*a*, 12*b* and on the other hand by the length difference of the two end levers 12*a*, 12*b*.

The movement of the moving parts is in this embodiment analogous to the movement of one of the linkages 2', 2" of FIG. 3 and will therefore not be explained here in more detail. The double arrows again represent the movement directions during the closing process.

Figure 5:
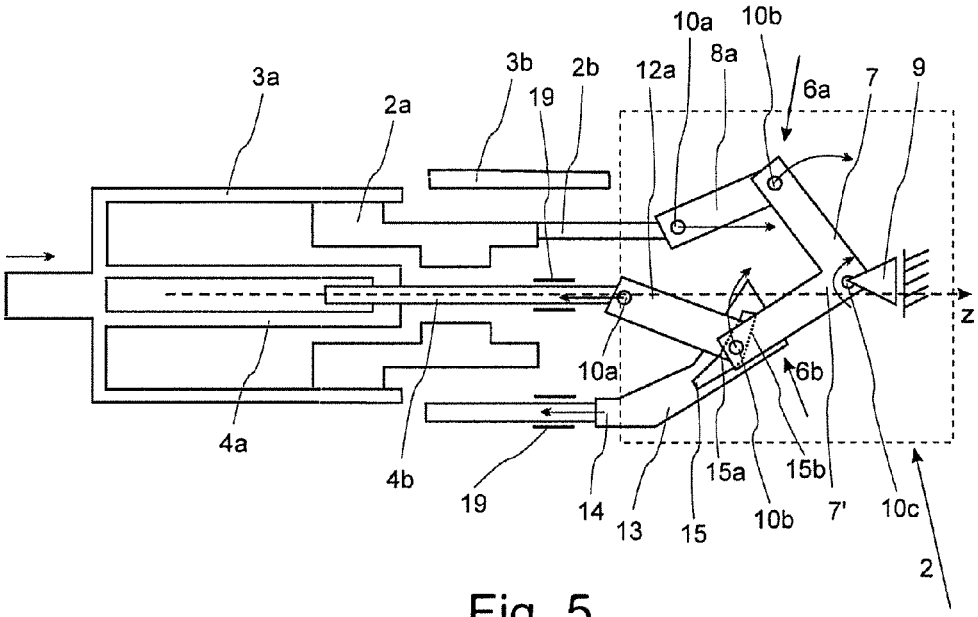

FIG. 5 shows a detail sectional side view of the contacts 3*a*, 3*b*, 4*a*, 4*b* of the circuit breaker 1 with a third embodiment of a contact arrangement according to the invention. In the following only the differences to the embodiment of FIG. 4 are described. In this embodiment the two end levers 12*a*, 13 are linked to the first lever 7' of the second kinematic chain 6*b* by means of a common joint 10*b*. The first end lever 12*a* has an identical connection like the one in FIG. 4. The second end lever 13 comprises a guide rail 15 which guides the common joint 10*b*. The second end lever 13 is fixedly attached to the third contact 3*b* by means of a joint 14. Thus it is attached to said contact 3*b* in a stiff way and can therefore only perform a translation movement parallel to the longitudinal axis z. Contrary to this the common joint 10*b* can only perform a rotational movement around the bearing 9, being constrained by the rigid first lever 7'. The result is that the third contact 3*b* is shifted back and forth by the constraint of the movement of the common joint 10*b* in the guide rail 15. When the electrical switching device 1 is being closed, the common joint 10*b* rotates in the direction shown by the double arrow, thus impacting a first side 15*a* of the guide rail 15 and gliding along it, thus forcing the corresponding end lever 13 to shift in the direction of the arrow of the joint 14. When the switching device 1 is being opened the common joint 10*b* rotates in the opposite direction, impacts a second side 15*b* of the guide rail and glides along it, thus forcing the corresponding end lever 13 to move in the direction of the arrow z. The difference between the transmission ratio of the first kinematic chain 6*a* with the one branch of the second kinematic chain 6*b* and the transmission ratio of the first kinematic chain 6*a* with the other branch of the second kinematic chain 6*b* is given by the shape of the guide rail 15. More precise, the steepness of the sides 15*a* and 15*b* with respect to the horizontal direction in the figure is decisive for the distance and acceleration of the end lever 13 in either shift direction.

Figure 6:
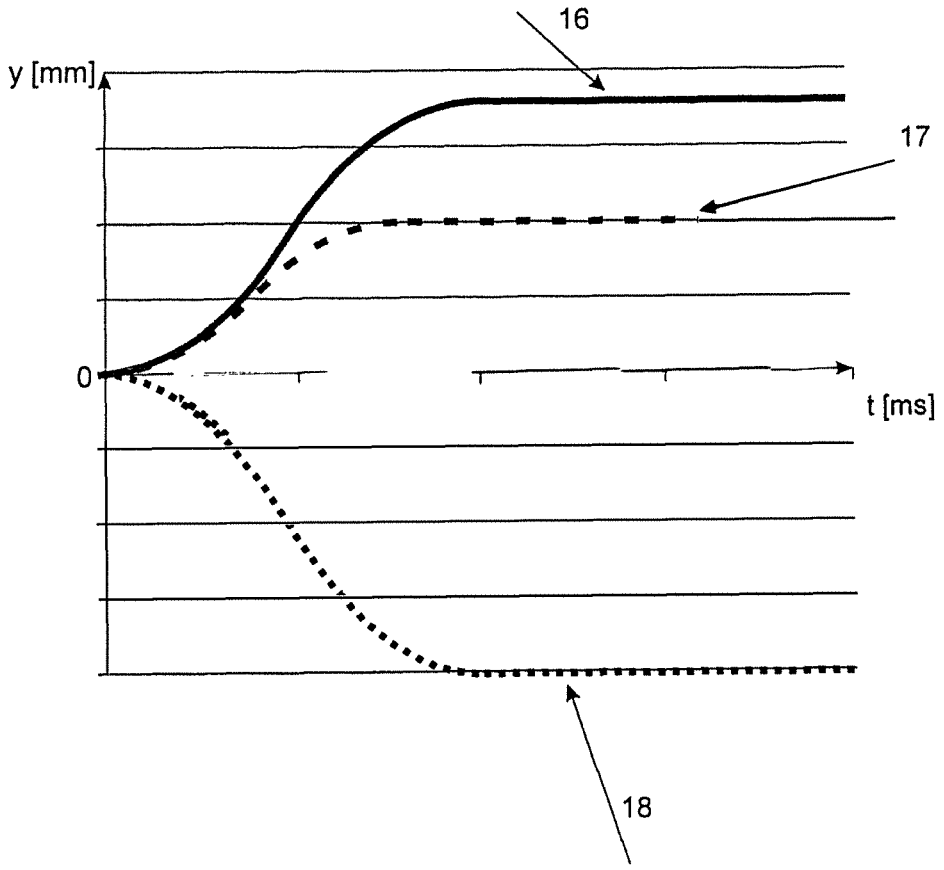
FIG. 6 is a diagram showing curves of a travel path over time of the contacts of the circuit breaker according to FIG. 1 with mechanical couplings according to the invention.

FIG. 6 shows a diagram showing curves of a travel path over time of the contacts 3*a*, 3*b*, 4*a*, 4*b* of the circuit breaker 1 with contact arrangements according to embodiments of the invention, e.g. during the opening process of the electrical switching device 1. As mentioned, exemplarily the first contact represents the nominal contact 3*a* of the first contact group, the second contact represents the arcing contact 4*a* of the first contact group, the third contact represents the nominal contact 3*b* of the second contact group and the fourth contact represents the arcing contact 4*b* of the second contact group. The axis of ordinates represents the shifting or travel distance of the contacts of the switching device 1 in millimeters and the axis of abscissae represents the time in milliseconds. The solid curve 16 shows a travel curve of the arcing contact 4*b*. The dashed curve 17 shows a travel curve of the nominal contact 3*b* and the dotted curve 18 shows the travel curve of the nominal and the arcing contact 3*a*, 4*a*. The value of zero meters represents the position in which the electrical switching device 1 is in a completely closed state and the contacts are idle or in their starting position. The positive and negative displacement values (Y-axis) of the shift values represent movements in opposite directions.

As can be seen, the arcing contact 4*b* travels a longer distance than the nominal contact 3*b*. The nominal contact 3*a* and the arcing contact 4*a* travel with the same speed and acceleration and cover the same distance as they are fixedly attached together. Generally it can be seen that the contacts are accelerated at the beginning of their travel path and are decelerated towards the end of their travel path. During the opening process the mechanical coupling 2 pulls back the nominal contact 3*b* and the arcing contact 4*b* in such a way that the nominal contact 3*b* disconnects first from the mating nominal contact 3*a* and thereafter the arcing contact 4*b* is decoupled from the mating arcing contact 4*a*.

During the closing process the contacts travel the curves of FIG. 6 in the opposite direction due to the nature of the mechanical coupling 2. The arcing contact 4*b* contacts the arcing contact 4*a* before the nominal contacts 3*a*, 3*b* contact one another. As can be derived from FIG. 6, the nominal contact 3*b* is positioned relatively close to the point where it will first touch the mating nominal contact 3*a* but, as it is travelling slower than the arcing contact 4*b*, it will reach the contact point later than the arcing contact 4*b* reaches its contact point with the mating arcing contact 4*a*. Therefore, the nominal contact 3*b* can be placed altogether closer to its mating contact. The advantage is that the mechanical forces acting during the movement are reduced and the required drive energy is smaller.

Advantageously, the mechanical coupling is adapted such that a predefined time period between the touching or separation of the nominal contact 3*a* and the nominal contact 3*b* and the touching or separation of the arcing contact 4*a* and the arcing contact 4*b* is not exceeded.

As mentioned, the mechanical coupling is advantageously adapted such that the arcing contact 4*b* is moved faster than the nominal contact 3*b*. Preferably, a speed of the nominal contact 3*b* and/or the arcing contact 4*b* is non-linear. In particular, the mechanical coupling 2 is adapted such that a speed of the third contact 3*b* is a first non-linear function of time and a speed of the fourth contact 4*b* is a second non-linear function of time, and the first and second non-linear functions are different. Additionally or alternatively the travel path of the arcing contact 4*b* may be longer than the travel path of the nominal contact 3*b*.

The described contact arrangement is preferably used in an electrical switching device like an earthing device, a fast-acting earthing device, a circuit breaker, a generator circuit breaker, a switch disconnector, a combined disconnector and earthing switch, or a load break switch. Where applicable, the first contact group 3*a*, 4*a* of the electrical switching device 1 is movable along the longitudinal axis z for closing and opening said electrical switching device 1 in order to provide the actuation force transmitted to the second contact group 3*b*, 4*b* by the mechanical coupling 2 of the contact arrangement according to a predefined transmission ratio and/or speed curve. In other switching devices, in which the first contact group is fixed, the electrical switching device may comprise the additional actuator mentioned above in order to provide the actuation force transmitted to the second contact group 3*b*, 4*b* by the mechanical coupling 2 of the contact arrangement, also according to a predefined transmission ratio and/or speed curve.

By providing a mechanical coupling according to the invention it is possible to make the switching device more compact even though the contacts of the switching device still have the same size. Furthermore, mechanical stress on the moving parts is reduced.

For the purposes of this disclosure the fluid used in the encapsulated or non-encapsulated electric apparatus or switching device 1 can be $SF_6$ gas or any other dielectric insulation medium, may it be gaseous and/or liquid, and in particular can be a dielectric insulation gas or arc quenching gas. Such dielectric insulation medium can for example encompass media comprising an organofluorine compound, such organofluorine compound being selected from the group consisting of: a fluoroether, an oxirane, a fluoroamine, a fluoroketone, a fluoroolefin and mixtures and/or decomposition products thereof. Herein, the terms "fluoroether", "oxirane", "fluoroamine", "fluoroketone" and "fluoroolefin" refer to at least partially fluorinated compounds. In particular, the term "fluoroether" encompasses both hydrofluoroethers and perfluoroethers, the term "oxirane" encompasses both hydrofluorooxiranes and perfluorooxiranes, the term "fluoroamine" encompasses both hydrofluoroamines and perfluoroamines, the term "fluoroketone" encompasses both hydrofluoroketones and perfluoroketones, and the term "fluoroolefin" encompasses both hydrofluoroolefins and perfluoroolefins. It can thereby be preferred that the fluoroether, the oxirane, the fluoroamine and the fluoroketone are fully fluorinated, i.e. perfluorinated.

In embodiments, the dielectric insulation medium is selected from the group consisting of: a (or several) hydrofluoroether(s), a (or several) perfluoroketone(s), a (or several) hydrofluoroolefin(s), and mixtures thereof.

In particular, the term "fluoroketone" as used in the context of the present invention shall be interpreted broadly and shall encompass both fluoromonoketones and fluorodiketones or generally fluoropolyketones. Explicitly, more than a single carbonyl group flanked by carbon atoms may be present in the molecule. The term shall also encompass both saturated compounds and unsaturated compounds including double and/or triple bonds between carbon atoms. The at least partially fluorinated alkyl chain of the fluoroketones can be linear or branched and can optionally form a ring.

In embodiments, the dielectric insulation medium comprises at least one compound being a fluoromonoketone and/or comprising also heteroatoms incorporated into the carbon backbone of the molecules, such as at least one of: a nitrogen atom, oxygen atom and sulphur atom, replacing one or more carbon atoms. More preferably, the fluoromonoketone, in particular perfluoroketone, can have from 3 to 15 or from 4 to 12 carbon atoms and particularly from 5 to 9 carbon atoms. Most preferably, it may comprise exactly 5 carbon atoms and/or exactly 6 carbon atoms and/or exactly 7 carbon atoms and/or exactly 8 carbon atoms.

In embodiments, the dielectric insulation medium comprises at least one compound being a fluoroolefin selected from the group consisting of: hydrofluoroolefins (HFO) comprising at least three carbon atoms, hydrofluoroolefins (HFO) comprising exactly three carbon atoms, trans-1,3,3,3-tetrafluoro-1-propene (HFO-1234ze), 2,3,3,3-tetrafluoro-1-propene (HFO-1234yf), trans-1,2,3,3,3 pentafluoroprop-1-ene (HFO-1225ye (E-isomer)), cis-1,2,3,3,3 pentafluoroprop-1-ene (HFO-1225ye (Z-isomer)), and mixtures thereof.

The dielectric insulation medium can further comprise a background gas or carrier gas different from the organofluorine compound (in particular different from the fluoroether, the oxirane, the fluoroamine, the fluoroketone and the fluoroolefin) and can in embodiments be selected from the group consisting of: air, $N_2$, $O_2$, $CO_2$, a noble gas, $H_2$; $NO_2$, NO, $N_2O$; fluorocarbons and in particular perfluorocarbons, such as $CF_4$; $CF_3I$, $SF_6$; and mixtures thereof.

While there are shown and described presently preferred embodiments of the invention, it is to be distinctly understood that the invention is not limited thereto but may otherwise variously be embodied and practised within the scope of the following claims. Therefore, terms like "preferred" or "in particular" or "particularly" or "advantageously", etc. signify optional and exemplary embodiments only.

LIST OF REFERENCE NUMERALS

1=circuit breaker
2=mechanical coupling
2'=first linkage
2"=second linkage
2*a*=insulating nozzle
2*b*=connecting rod
3=electric arc
3*a*=first nominal contact
3*b*=second nominal contact
4*a*=first arcing contact
4*b*=second arcing contact
5=shell
5*a*=shielding
6*a*=first kinematic chain of first linkage
6*b*=second kinematic chain of first linkage
6*c*=first kinematic chain of second linkage
6*d*=second kinematic chain of second linkage
7, 7', 7*a*, 7*a'*=first lever of kinematic chains
8*a*=end lever of first kinematic chain of first linkage
8*b*=end lever of second kinematic chain of first linkage
8*c*=end lever of first kinematic chain of second linkage
8*d*=end Sever of second kinematic chain of second linkage
9=bearing of first linkage

9*a*=bearing of second linkage
10*a*=joints between levers and contacts, end joints
10*b*=joints between two levers, common joints
12*a*=first end lever
12*b*=second end lever
13=guide rail end lever
14=fixed joint
15=guide rail of end lever
15*a*=first side of guide rail
15*b*=second side of guide rail
16=travel curve of fourth contact
17=travel curve of third contact
18=travel curve of first and second contact
30-36=double arrows representing moving directions
s=mechanical coupling according to the prior art
z=longitudinal axis

What is claimed is:

1. A contact arrangement having a longitudinal axis and comprising:

a first contact group with a first contact and a second contact and a second contact group with a third contact and a fourth contact, the first contact interacting electrically and mechanically with the third contact and/or the second contact interacting electrically and mechanically with the fourth contact, for closing and opening the contact arrangement, the first contact and the second contact configured to have a same speed, at least one mechanical coupling configured to transmit an actuation force to the second contact group and thereby move the second contact group, the at least one mechanical coupling configured to move the third contact and the fourth contact in such a way that speeds of the third contact and the fourth contact differ along at least a portion of a travel path of the third contact or along at least a portion of a travel path of the fourth contact, wherein the at least one mechanical coupling is a linkage having a first kinematic chain and a second kinematic chain, wherein the first kinematic chain is movably connected to the first contact group in an electrically insulating manner and the second kinematic chain is movably connected to the second contact group, and wherein the first kinematic chain has at least two levers, with a first lever of the first kinematic chain rotationally connected to a bearing and fixedly connected to a first lever of the second kinematic chain, and with an end lever of the first kinematic chain movably connected to the first contact group.

2. The contact arrangement according to claim 1, wherein the first contact and the third contact are nominal contacts, and/or the second contact and the fourth contact are arcing contacts; and/or the first contact group is on one side of an arcing zone of a circuit breaker and the second contact group is on an opposite side of the arcing zone, when seen along the longitudinal axis.

3. The contact arrangement device according to claim 1, wherein the first kinematic chain is movably connected to the first contact group by an intermediary member, and wherein the intermediary member is linearly movable parallel to the longitudinal axis by a mechanical force.

4. The contact arrangement according to claim 3, wherein the first lever of the first kinematic chain and the end lever of the first kinematic chain are connected by a common joint; and/or wherein the connecting rod is attached to the end lever of the first kinematic chain by an end joint.

5. The contact arrangement device according to claim 3, wherein the mechanical force is exerted on the intermediary member by a movable insulating nozzle of the first contact group.

6. The contact arrangement according to claim 4, wherein the common joint connecting the first lever with the second lever of the first kinematic chain performs a rotational movement around the bearing; and/or the common joint connecting the first lever with the second lever of the second kinematic chain performs a rotational movement around the bearing; and/or the end joints perform a linear movement parallel to the longitudinal axis; and/or a joint connecting the bearing with the first lever of the first kinematic chain is stationary and only allows a rotational movement of the first lever of the first kinematic chain; and/or a joint connecting the bearing with the first lever of the second kinematic chain is stationary and only allows a rotational movement of the first lever of the second kinematic chain.

7. The contact arrangement according to claim 1, wherein the second kinematic chain has at least two levers, the first lever of the second kinematic chain rotationally connected to the bearing and fixedly connected to the first lever of the first kinematic chain, and an end lever of the second kinematic chain movably connected to the second contact group.

8. The contact arrangement according to claim 7, wherein the first lever and the end lever of the second kinematic chain are connected by a common joint, and/or wherein the end lever of the second kinematic chain is pivotably attached by an end joint to the second contact group.

9. The contact arrangement according to claim 7, wherein the at least one mechanical coupling comprises a first linkage and a second linkage, and the end levers of the first kinematic chain of each one of the linkages are pivotably connected by end joints to the first contact group in such a way that they are moved by the first contact group simultaneously; and wherein the end joints of the end levers of the first kinematic chains perform a linear movement parallel to the longitudinal axis.

10. The contact arrangement according to claim 9, wherein an end lever of the second kinematic chain of the first linkage is pivotably connected by an end joint to the fourth contact, and/or an end lever of the second kinematic chain of the second linkage is pivotably connected by an end joint to the third contact;

wherein the end joints of the end levers of the second kinematic chains perform a linear movement parallel to the longitudinal axis.

11. The contact arrangement according to claim 9, wherein a transmission ratio between the first kinematic chain and the second kinematic chain of the first linkage is not equal to a transmission ratio between the first kinematic chain and the second kinematic chain of the second linkage.

12. The contact arrangement according to claim 1, wherein the at least one mechanical coupling comprises one linkage and the second kinematic chain of the one linkage comprises two end levers, of which a first end lever is pivotably connected at one end by an end joint to the third contact and a second end lever is pivotably connected at one end by an end joint to the fourth contact.

13. The contact arrangement according to claim 12, wherein each end lever of the second kinematic chain is pivotably connected to a neighbouring lever of the second kinematic chain by a distinct joint.

14. The contact arrangement according to claim 12, wherein the two end levers of the second kinematic chain are connected to a neighbouring lever of the second kinematic chain by a common joint.

15. The contact arrangement according to claim 14, wherein the common joint connects one of the end levers of the second kinematic chain pivotably with the fourth contact, and the other end lever of the second kinematic chain is connected fixedly to the third contact and comprises a guide rail guiding the common joint.

16. The contact arrangement according to claim 15, wherein a difference between a transmission ratio of the first kinematic chain with one branch of the second kinematic chain and a transmission ratio of the first kinematic chain with another branch of the second kinematic chain is given by a shape of the guide rail.

17. The contact arrangement according to claim 16, wherein the difference is given by a steepness of sides of the guide rail relative to the longitudinal axis.

18. The contact arrangement according to claim 12, wherein a transmission ratio between the first kinematic chain and the second kinematic chain with one of the end levers is not equal to a transmission ratio between the first kinematic chain and the second kinematic chain with another of the end levers.

19. The contact arrangement according to claim 1, wherein the mechanical coupling is configured such that a predefined time period between touching or separation of the first contact and third contact and touching or separation of the second contact and the fourth contact is not exceeded.

20. The contact arrangement according to claim 1, wherein the mechanical coupling is configured such that the fourth contact is moved faster than the third contact, and/or that the travel path of the fourth contact is longer than the travel path of the third contact.

21. The contact arrangement according to claim 1, wherein the mechanical coupling is configured such that the speed of the third contact and/or the speed of the fourth contact is non-linear as a function of time.

22. The contact arrangement according to claim 21, wherein the mechanical coupling is configured such that the speed of the third contact is a first non-linear function of time and the speed of the fourth contact is a second non-linear function of time; and wherein the first and second non-linear functions are different.

23. The contact arrangement according to claim 1, wherein the third contact is provided with a guiding element for guiding the third contact along a linear path during the closing and the opening of the contact arrangement, and/or the fourth contact is provided with a guiding element for guiding the fourth contact along a linear path during the closing and the opening of the contact arrangement.

24. An electrical switching device comprising a contact arrangement according to claim 1, wherein the first contact group is movable along the longitudinal axis to close and open said electrical switching device.

25. The electrical switching device according to claim 24, the electrical switching device configured as an earthing device, a fast-acting earthing device, a circuit breaker, a generator circuit breaker, a switch disconnector, a combined disconnector and earthing switch, or a load break switch.

26. The electrical switching device according to claim 24, wherein the electrical switching device includes a dielectric insulation gas that comprises an organofluorine compound selected from the group consisting of: a fluoroether, an oxirane, a fluoroamine, a fluoroketone, a fluoroolefin; and mixtures and/or decomposition products thereof.

27. An electrical switching device comprising a contact arrangement having a longitudinal axis and comprising:

a first contact group with a first contact and a second contact and a second contact group with a third contact and a fourth contact, the first contact interacting electrically and mechanically with the third contact and/or the second contact interacting electrically and mechanically with the fourth contact, for closing and opening the contact arrangement, the first contact group is on one side of an arcing zone of a circuit breaker and the second contact group is on the other side of the arcing zone, when seen along the longitudinal axis, at least one mechanical coupling configured to transmit an actuation force to the second contact group and thereby move the second contact group, the at least one mechanical coupling configured to move the third contact and the fourth contact in such a way that speeds of the third contact and the fourth contact differ along at least a portion of a travel path of the third contact or along at least a portion of a travel path of the fourth contact, wherein the at least one mechanical coupling is a linkage having a first kinematic chain and a second kinematic chain, wherein the second kinematic chain is movably connected to the second contact group, and wherein the first kinematic chain has at least two levers, with a first lever of the first kinematic chain rotationally connected to a bearing and fixedly connected to a first lever of the second kinematic chain, and with an end lever of the first kinematic chain movably connected to an actuator of the electrical switching device for providing the actuation force transmitted to the second contact group by the mechanical coupling of the contact arrangement according to a predefined transmission ratio and/or speed curve.

28. A contact arrangement having a longitudinal axis and comprising:

a first contact group with a first contact and a second contact, and a second contact group with a third contact and a fourth contact;

the first contact interacting electrically and mechanically with the third contact and/or the second contact interacting electrically and mechanically with the fourth contact, for closing and opening the contact arrangement;

at least one mechanical coupling configured to transmit an actuation force to the second contact group and thereby move the second contact group;

the at least one mechanical coupling configured to move the third contact and the fourth contact in such a way that speeds of the third contact and the fourth contact differ along at least a portion of a travel path of the third contact or along at least a portion of a travel path of the fourth contact;

wherein the at least one mechanical coupling is a linkage having a first kinematic chain and a second kinematic chain, wherein the first kinematic chain is movably connected to the first contact group in an electrically insulating manner and the second kinematic chain is movably connected to the second contact group;

wherein the first kinematic chain has at least two levers, with a first lever of the first kinematic chain rotationally connected to a bearing and fixedly connected to a first lever of the second kinematic chain, and with an end lever of the first kinematic chain movably connected to the first contact group;

wherein the second kinematic chain has at least two levers, the first lever of the second kinematic chain rotationally connected to the bearing and fixedly connected to the first lever of the first kinematic chain, and an end lever of the second kinematic chain movably connected to the second contact group;

wherein the at least one mechanical coupling comprises a first linkage and a second linkage, and the end levers of the first kinematic chain of each one of the linkages are pivotably connected by end joints to the first contact group in such a way that they are moved by the first contact group simultaneously; and wherein the end joints of the end levers of the first kinematic chains perform a linear movement parallel to the longitudinal axis.

29. The contact arrangement according to claim 28, wherein an end lever of the second kinematic chain of the first linkage is pivotably connected by an end joint to the fourth contact, and/or an end lever of the second kinematic chain of the second linkage is pivotably connected by an end joint to the third contact;

wherein the end joints of the end levers of the second kinematic chains perform a linear movement parallel to the longitudinal axis.

30. The contact arrangement according to claim 28, wherein a transmission ratio between the first kinematic chain and the second kinematic chain of the first linkage is not equal to a transmission ratio between the first kinematic chain and the second kinematic chain of the second linkage.

31. A contact arrangement having a longitudinal axis and comprising:

a first contact group with a first contact and a second contact, and a second contact group with a third contact and a fourth contact;

the first contact interacting electrically and mechanically with the third contact and/or the second contact interacting electrically and mechanically with the fourth contact, for closing and opening the contact arrangement;

at least one mechanical coupling configured to transmit an actuation force to the second contact group and thereby move the second contact group;

the at least one mechanical coupling configured to move the third contact and the fourth contact in such a way that speeds of the third contact and the fourth contact differ along at least a portion of a travel path of the third contact or along at least a portion of a travel path of the fourth contact;

wherein the at least one mechanical coupling is a linkage having a first kinematic chain and a second kinematic chain, wherein the first kinematic chain is movably connected to the first contact group in an electrically insulating manner and the second kinematic chain is movably connected to the second contact group;

wherein the first kinematic chain has at least two levers, with a first lever of the first kinematic chain rotationally connected to a bearing and fixedly connected to a first lever of the second kinematic chain, and with an end lever of the first kinematic chain movably connected to the first contact group;

wherein the at least one mechanical coupling comprises one linkage and the second kinematic chain of the one linkage comprises two end levers, of which a first end lever is pivotably connected at one end by an end joint to the third contact and a second end lever is pivotably connected at one end by an end joint to the fourth contact;

wherein the two end levers of the second kinematic chain are connected to a neighbouring lever of the second kinematic chain by a common joint;

wherein the common joint connects one of the end levers of the second kinematic chain pivotably with the fourth contact, and the other end lever of the second kinematic chain is connected fixedly to the third contact and comprises a guide rail guiding the common joint; and wherein a difference between a transmission ratio of the first kinematic chain with one branch of the second kinematic chain and a transmission ratio of the first kinematic chain with another branch of the second kinematic chain is given by a shape of the guide rail.

* * * * *